United States Patent [19]

Onisko

[11] 4,237,716

[45] Dec. 9, 1980

[54] SHEET METAL BRAKE WITH IMPROVED LOCKING MECHANISM

[75] Inventor: William Onisko, Southfield, Mich.

[73] Assignee: Van Mark Products Corporation, Farmington Hills, Mich.

[21] Appl. No.: 14,445

[22] Filed: Feb. 23, 1979

[51] Int. Cl.[3] ..... B21D 11/04

[52] U.S. Cl. ..... 72/319

[58] Field of Search ..... 72/319, 296; 269/153, 269/218

[56] References Cited

U.S. PATENT DOCUMENTS

| | | | |
|---|---|---|---|
| 3,147,791 | 9/1964 | Rauen et al. | 72/319 |
| 3,559,444 | 2/1971 | Blazey et al. | 72/319 |

*Primary Examiner*—Milton S. Mehr

*Attorney, Agent, or Firm*—Krass & Young

[57] ABSTRACT

A brake for bending sheet metal includes upper and lower clamping members, with a pressure slideably mounted on the upper clamping member. A bell crank is advantageously provided with its longer arm being utilized as a handle. The bell crank is pivotally engaged with the upper clamping member and its shorter arm is coupled by a link to the pressure member. When the handle is rotated towards the clamping members, the toggle action of the linkage provides maximum force per unit rotation at the top of the stroke to securely lock the upper clamping member against the lower clamping member. A stop is utilized to prevent further movement of the handle once the link-shorter arm pivot point travels slightly past an imaginary line between the bell crank and the link-pressure member pivots. In one embodiment, the linkage is adjustable in length to regulate the amount of clamping force. The locking mechanism is coupled to the brake in such manner that it does not bridge the upper and lower clamping members. Accordingly, sheet metal can be placed into the brake which extends beyond the locking mechanism thereby permitting only selected portions to be bent by the rotation of a bending member longitudinally hinged to the lower clamping member.

16 Claims, 9 Drawing Figures

SHEET METAL BRAKE WITH IMPROVED LOCKING MECHANISM

BACKGROUND OF THE INVENTION

This invention relates to brakes for bending sheet metal such as aluminum siding to be applied to buildings.

Large, stationary brakes for making angular bends in sections of sheet metal which employ a pair of jaws and a bending arm hinged to one of the jaws operative to engage the extending section of a sheet work piece clamped between the jaws have long been used in shops for forming sheet metal duct work and the like. In recent years, the increased use of aluminum as a siding or veneer material for buildings has given rise to the development of a class of portable, lightweight brakes that may be used in the field by workmen applying aluminum siding to a structure. In order to custom form sections required to conform to windows, door openings, etc., these brakes have typically employed a number of spaced C-shaped frame members joined together by rails. A fixed clamping surface extends along one end of the C-shaped frame members and a movable clamping surface is supported on the other edge of the frame which is movable toward and away from fixed surface. U.S. Pat. Nos. 3,559,444, 3,592,037 and 3,817,075 illustrate representative samples of these brakes wherein the movable clamping member is actuated by sliding wedges which move normally to the C-shaped members to force the movable clamp into engagement with the lower clamping member to hold the sheet metal.

In U.S. Pat. No. 3,592,037, a handle disposed at one end of the brake is manually rotatable to actuate the sliding wedges. The pivot point on the handle is coupled to the lower clamping member while the wedges are coupled to the handle a small distance above the pivot point. Unfortunately, with this type of locking mechanism, when the workman reaches the top of the stroke, there is a tendency for him to provide excessive force on the handle. This is due to the fact that unit motion of the handle produces only unit motion of the wedges which, in turn, provides the clamping action between the upper and lower clamping members. Such excessive force has been found to create undue stress on the track on which the wedges are mounted thereby damaging the track and its associated guideways in such manner to cause a loose fit therebetween.

Furthermore, such locking arrangements have prevented the sheet metal from extending beyond the handle since it is coupled to the lower clamping member as well as to the slidable wedges mounted on the upper clamping member. In custom forming sheet metal, it is often desirable to provide a bend only in selected portions of the metal along a transverse cut therein. With the aforementioned locking mechanisms, this cannot be conveniently accomplished since the locking mechanism prevents the portions of the sheet metal which are not desired to be bent from extending beyond the handle.

SUMMARY OF THE INVENTION

Therefore, the present invention provides a locking mechanism which does not impede the extension of the sheet metal beyond the handle. Furthermore, increased clamping action is provided by this invention in such a manner that workmen will not have a tendency to use excessive force which may damage the brake. A bell crank is advantageously employed by pivotally mounting it on the movable upper clamping surface. The bell crank has two arms, the longer of which serves as a handle. The end of the shorter arm is coupled by a link to the pressure member slidably mounted on the upper clamping surface, preferably by connecting it to a wedge mounted thereon. Accordingly, the entire locking mechanism is disposed upwardly of the upper clamping member so as to permit sheet metal to extend beyond the handle. A stop member is preferably utilized to restrict further movement of the handle in the locking direction once the linkshorter arm pivot point travels slightly past an imaginary line connecting the bell crank pivot and link-pressure member pivot points. Accordingly, the present invention provides an overcenter locking mechanism by which maximum force is delivered to the pressure member near the end of the locking stroke of the handle. Therefore, the workmen can feel the locking mechanism having been locked in place and consequently, the tendency for him to apply further force to the handle which could damage the brake is minimized.

BRIEF DESCRIPTION OF THE DRAWINGS

These and other advantages of this invention will become apparent upon reading the following specification and by reference to the drawing in which.

DESCRIPTION OF THE PREFERRED EMBODIMENT

Figure 1:
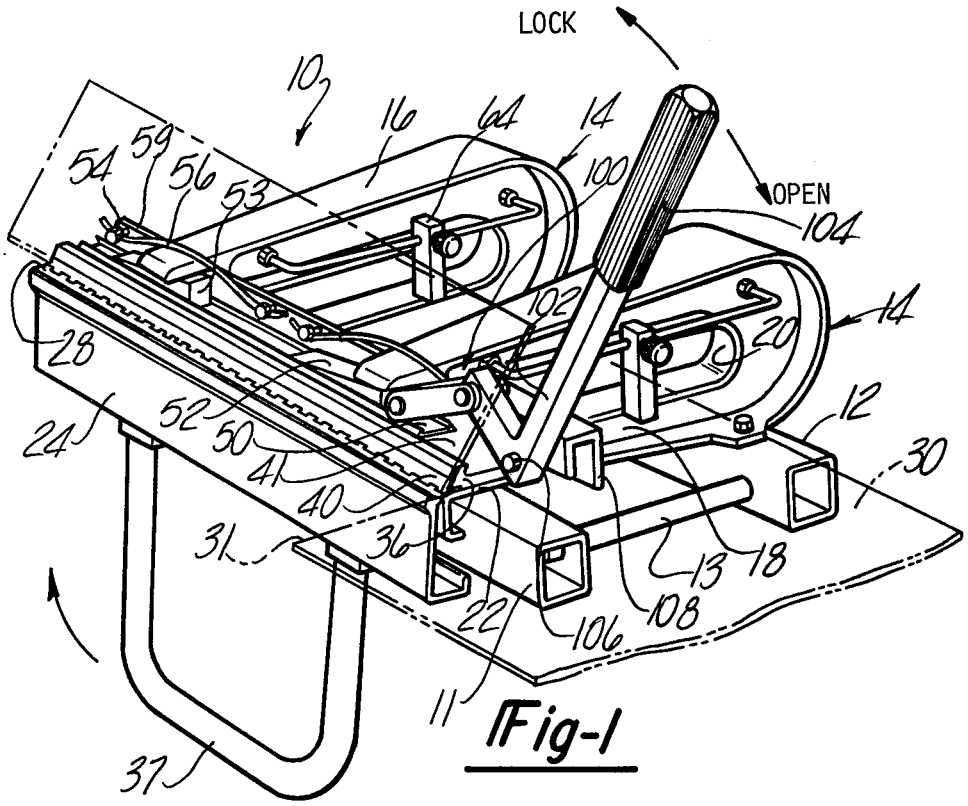
FIG. 1 is a perspective view of a brake for bending sheet metal in accordance with a preferred embodiment of this invention.

Referring to FIG. 1, brake 10 includes two elongated base sections 11 and 12, having a cross-sectional box design coupled together by a plurality of transverse rails 13. Mounted transversely of base sections 11, 12 at longitudinally spaced intervals are at least two C-shaped members 14, having upper and lower arms, 16 and 18, respectively. Preferably, members 14 are constructed of cast aluminum and have a throat 20 depth to accommodate the sheet metal inserted into the brake 10. It should be noted that while only two C-members 14 are shown in FIG. 1, it is well known to those skilled that most brakes are much longer and may contain as many as one dozen or more individual C-members 14 spaced at longitudinal intervals along the lengths of the base sections 11 and 12.

Lower clamping member 22 is affixed to the lower arms 18 of C-members 14. A bending member 24 is longitudinally hinged to lower clamping member 22 as can be seen most clearly in FIG. 1. Bending member 24 includes a bending surface 28 which performs the actual bending operation on the sheet material 30 shown in phantom lines in the drawings. An upper clamping member 36 is attached to the upper arm 16 of C-members 14 by means of a spring rod arrangement wherein a resilient steel rod 56 is bowed over tongue 58 of upper arm 16 and hooked at each end around bolts 54 fastened to an upwardly extending side wall portion 59 of upper clamping member 36. Spring rods 56 serve to normally bias upper clamping member 36 away from lower clamping member 22.

The front edge of upper member 36 may include a removable guard 40 for uniformly defining a straight edge about which the sheet metal 30 can be bent.

The bottom surface of the upper clamping member 36 is grooved to form a guideway for a track 41 in which a slidable pressure member 50 is received. Pressure member 50 includes a plurality of inclined wedges 52 and 53 longitudinally spaced in underlying relationship to upper arms 16 of C-members 14.

Measuring stops 64 depending from the upper arms 16 of C-members 14 are adjustable with respect to the throat 20 and provide a surface against which the end of sheet metal 30 may abut. A scale (not shown) can be provided on arm 16 to measure the distance between stop 64 and the bending edge of guard 40 of upper clamping member 36.

Special attention should now be directed to the locking mechanism generally designated by the reference numeral 100. An L-shaped bell crank 102 includes two arm portions orthogonally connected at the heel of the L. The longer arm portion serves as a lever handle 104. A bolt 106, passing through the heel of bell crank 102 engages a bracket 108 on wall 59 of upper clamping member 36. Hence, a fixed pivot point is defined by bolt 106 by which bell crank 102 is pivotally engaged with upper clamping member 36. The distal end of the shorter bell crank arm 110 is connected by bolt 112 to two links 114 and 116 on either side of arm 110 as can be seen most clearly in FIG. 2. Opposite ends of links 114 and 116 are coupled to wedge 52 by bolt 118. As can be seen most clearly in FIG. 2, wedge 52 includes an indentation 120 disposed on either side of its blunt edge for receipt of links 114 and 116. Accordingly, another aspect of this invention is the provision of indentations 120 on wedge 52 which can be thus easily manufactured to provide a readily connectable surface to which the force transferring links are mounted.

Figure 3:
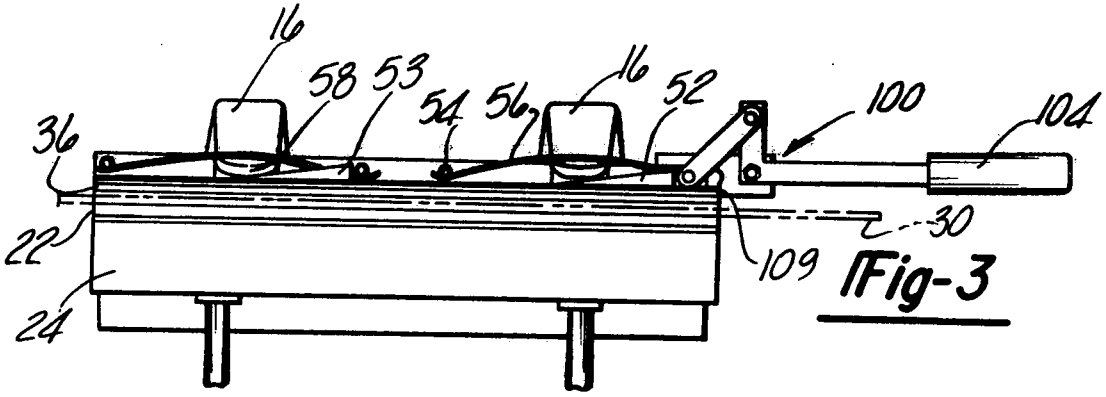
FIG. 3 is a front plan view of the brake shown in FIG. 1 in which the handle of the locking mechanism is illustrated in its open position.

The advantages of the present invention can be more readily understood by way of an example. Assume that it is desirous to bend only selected portions of sheet metal 30 to provide a custom form. A transverse cut 31 FIG. 1 is made in sheet material 30 separating the selected portions thereof which are desired to be bent. Referring especially to FIG. 3, handle 104 is placed in its open position and sheet metal 30 is placed between lower clamping member 22 and upper clamping member 36 with cut 31 being aligned with the lateral ends of members 22 and 36. Since locking mechanism 100 is disposed entirely above lower clamping member 22, the portions of sheet metal 30 which are not desired to be bent can extend beyond brake 10. For purposes of this invention, the term open position means that handle 104 is in such orientation that pressure member 50 provides the least amount of force to upper clamping member 36.

Figure 2:
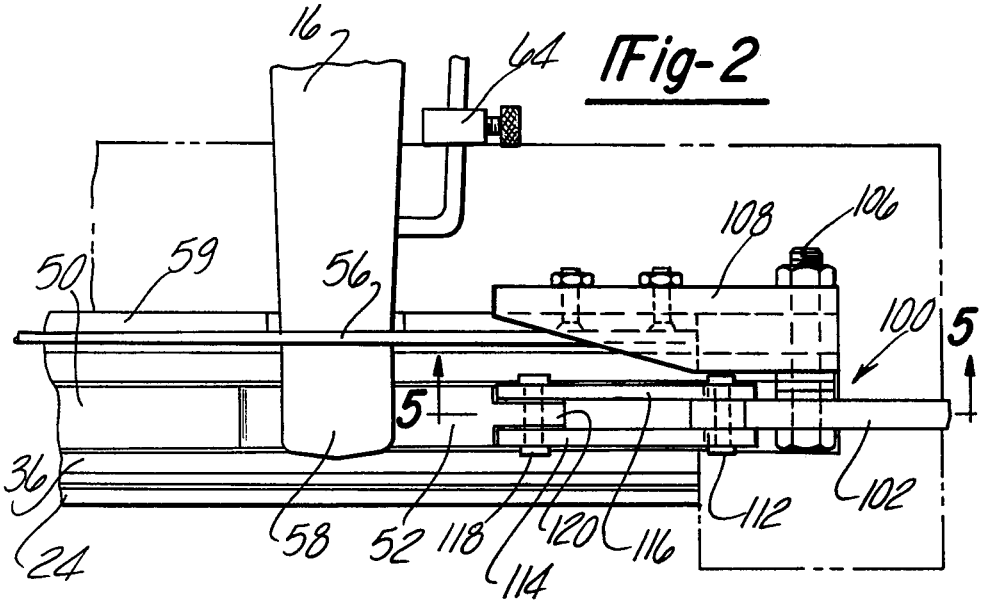
FIG. 2 is a partial top plan view of the brake shown in FIG. 1 illustrating the connection of the locking mechanism.
Figure 5:
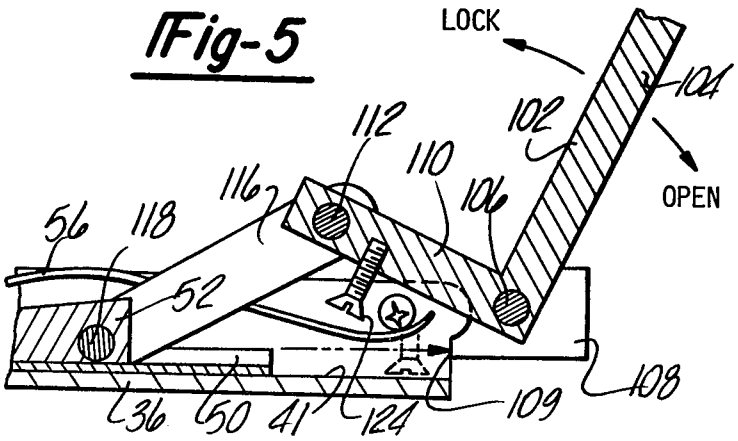
FIG. 5 is a cross-sectional view along with lines 5—5 of FIG. 2 in which the dotted lines show the transition from a partially open to a locked position of the handle.
Figure 4:
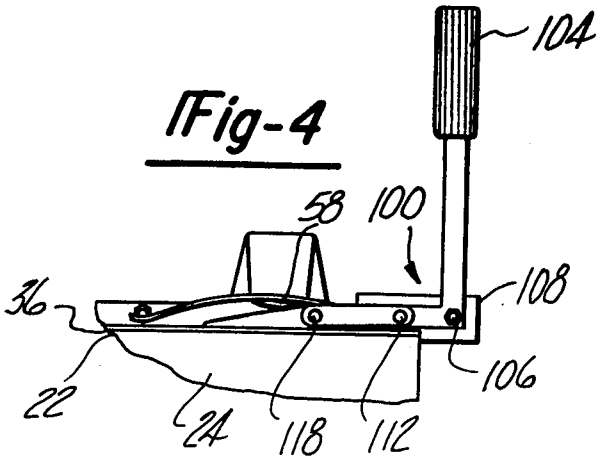
FIG. 4 is a partial front plan view of the brake shown in FIG. 3 in which the handle is illustrated in its locked position.
Figure 6:
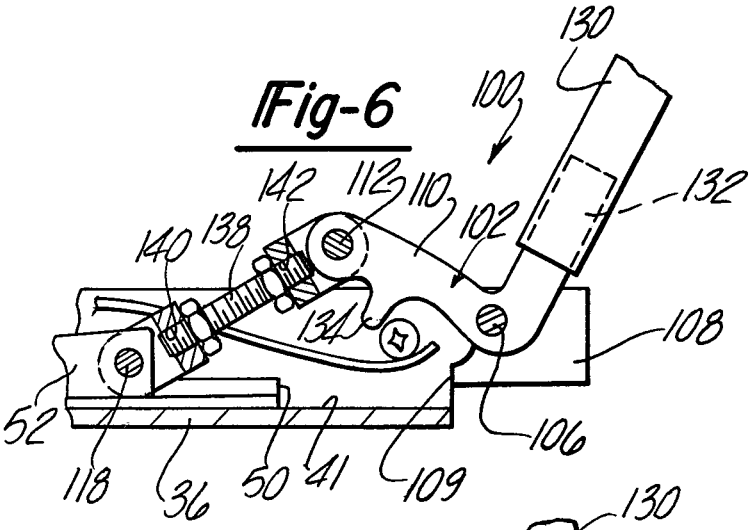
FIG. 6 is a side view of an alternative embodiment of the locking mechanism.
Figure 7:
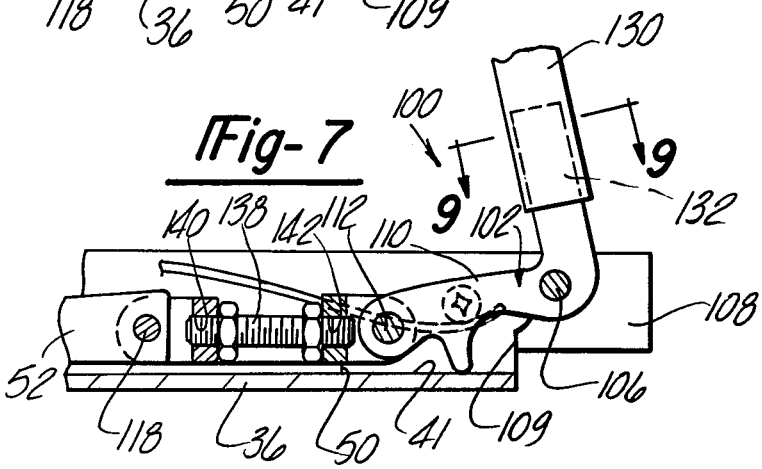
FIG. 7 is a side plan view of the locking mechanism of FIG. 6 which is illustrated in its locked position.
Figure 8:
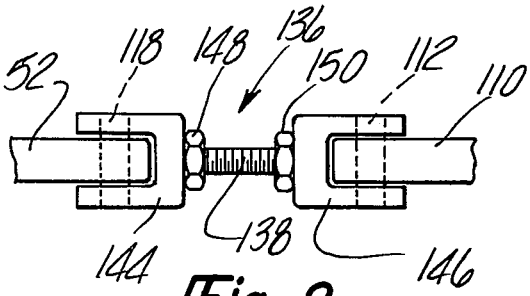
FIG. 8 is a top plan view of the adjustable linkage utilized in the locking mechanism of FIG. 6.
Figure 9:
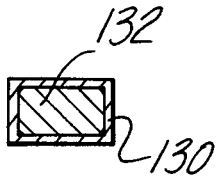
FIG. 9 is a cross-sectional view along the lines 9—9 of FIG. 7.

After sheet material 30 has been placed in brake 10, handle 104 is rotated upwardly in the direction of clamping members 22 and 36 to its locked position. FIGS. 1, 2 and 5 show handle 104 in the transition between the open and locked positions. FIG. 4 shows handle 104 in its locked position. As can be seen in the drawings, as handle 104 is rotated toward its locked position, pressure member 50 is moved leftwardly causing tongue 58 of C-members 14 to engage the inclined surfaces of wedges 52 and 53 thereby producing a downward force on upper clamping member 36. As can be seen most clearly in FIG. 5, when handle 104 reaches near the top of its stroke, a maximum amount of force is applied to pressure member 50 per unit motion of handle 104 due to the mechanical advantage derived from the toggle action of the linkage mechanism comprised of bell crank 102 and links 114, 116. A stop member 124 depending from lower portions of bell crank arm 110 restricts further movement of arm 104 once link-arm pivot point 112 travels through an imaginary center line drawn between bell crank pivot point 106 and the link-wedge pivot point 118. As can be seen in FIG. 4 and by the phantom lines in FIG. 5, locking mechanism 100 employs an overcenter linkage construction to rigidly hold sheet metal 30 between clamping members 22 and 36. Preferably, the bell crank pivot point 106 is vertically offset from a horizontal line passing through point 118. Stop member 124 is shown as a screw in this embodiment which is adjustable to regulate the amount of overtravel of pivot point 112 with relationship to the center line between points 106 and 118. It is evident that only a minimal amount of overtravel is desired since once point 112 passes the center line, further rotation of handle 104 would cause pressure member 50 to move rightwardly. Accordingly, for purposes of this invention, when point 112 is substantially along the imaginary center line between points 118 and 106, handle 104 will be deemed to be in its locked position. Now it becomes readily apparent to one skilled in the art that a workman utilizing brake 10 will notice that handle 104 has reached its locked position since the head of stop member 124 will have abutted track 41 of upper clamping member 36, and consequently, will not have a tendency to exert further, potentially damaging force to the handle 104.

In order to make the bend, the workman merely lifts upwardly on the bending member handle 37 (FIG. 1) to bring bending surface 28 into engagement with overlying portions of sheet metal 30 to bend it against the inclined front portion of upper clamping member 36. Such a bend is shown in phantom lines in FIG. 1. To release sheet metal 30 from brake 10, handle 104 is then rotated toward its open position whereby springs 56 urge upper clamping member 36 upwardly to release sheet metal 30. As can be seen most clearly in FIG. 5, the U-shaped bracket 108 includes a leg portion 109 extending into the rightwardly path of travel of pressure member 50 to provide a surface against which the end of pressure member 50 abuts once handle 104 is in its fully open position. Accordingly, accidental or even maliciously applied further force to handle 104 will not provide any further movement of pressure member 50 which could damage brake 10.

FIGS. 6–9 show an alternate embodiment for the locking mechanism 100. Common reference numerals will be utilized to refer to elements common with those elements in the embodiment of FIGS. 1–5. In this alternative embodiment, the elongated handle is removable which facilitates easy handling and storage. Handle 130 is a hollow, rigid tube and has a generally rectangular cross section. The hollowed out portion of handle 130 slips over a generally rectangular solid arm 132 portion of bell crank 102 and provides the desired leverage. The handle 30 may be easily removed for storing thereby eliminating the otherwise obtrusive projection.

In this embodiment, bell crank 102 includes an integral projection 134 which serves as a stop member which engages track 41 when the locking mechanism is in its locked position.

Provision is made according to a feature of this invention for adjusting the amount of clamping force. An adjustable linkage 136 couples the arm 110 of the locking mechanism 100 to wedge 52 on pressure member 50. Linkage 136 includes a threaded stud 138 which is mated at each end with a female threaded opening 140, 142 in brackets 144 and 146, respectively. Brackets 144, 146 are generally U-shaped and include openings in their end portions for receipt of mounting pins 118, 112, respectively, which are removable; e.g. by detaching cotter pins (not shown) on one end thereof. Linkage 136 includes two jamb nuts 148, 150 for maintaining the selected length of linkage 136. As can be readily envisioned, by removing pins 118 or 112 and turning brackets 144 and 146 in an appropriate direction, the distance between points 112 and 118 can be shortened or lengthened. Alternatively, openings 140, 142 may be reversely threaded such that this distance can be adjusted merely by loosening jamb nuts 148, 150 and rotating stud 138 which may include wrench flats in central portions thereof. By lengthening this distance, the amount of downward force on clamping surface 36 will be increased due to the wider portion of wedges 52, 53 being pushed beneath tongue 58 of member 16. Conversely, by shortening this length, the clamping force will be decreased. Accordingly, the clamping force may be regulated to accommodate different types of metals of various hardness without fear of distorting the metal sheet between the clamping surfaces due to too high of a clamping force. Of course, regulation of the clamping force may be needed for other purposes as well.

Therefore, while this invention has been described in connection with particular embodiments thereof, no limitation is intended thereby except as defined in the appended claims.

I claim:

1. In a brake for bending sheet metal having upper and lower clamping members, with a pressure member slidably mounted on the upper clamping member, the improvement comprising a locking mechanism which permits the sheet metal to extend longitudinally from the clamping members to perform bends on selected portions of said sheet metal, said locking mechanism including a bell crank having a heel portion thereof pivotally engaged with said upper clamping member, said bell crank having first and second arm portions, said first arm portion serving as at least a portion of a handle, and link means connected at one end to said pressure member and connected at the other end to said second arm portion, wherein rotation of said handle toward the clamping members creates a force in said pressure member which urges the upper clamping member toward the lower clamping member to secure the sheet metal therebetween, with said locking mechanism being wholly disposed upwardly of said lower clamping member so that the sheet metal can extend beyond the handle.

2. The improvement of claim 1 which further comprises stop means for restricting further rotation of said handle toward the locked position once the link-second arm point of connection travels through an imaginary line drawn between the bell crank pivot point and the link-pressure member pivot point thereby providing an overcenter locking construction for said locking mechanism.

3. The improvement of claim 2 wherein said bell crank pivot point is vertically offset from an imaginary line passing through said link-pressure member pivot point, parallel with said pressure member.

4. The improvement of claim 3 wherein said pressure member includes at least one wedge mounted thereon, and wherein said link means is connected to the wedge.

5. The improvement of claim 4 wherein said wedge includes indentations disposed at its blunt end for receiving the link means.

6. The improvement of claim 5 wherein said stop means includes an adjustable screw depending from said second arm for engaging top portions of said upper clamping member when said handle is in a locked position.

7. The improvement of claim 1 which further comprises abutment means projecting into the path of travel of said pressure member for engaging said pressure member when said handle is in an open position to prevent further movement thereof.

8. The improvement of claim 7 which further comprises a bracket coupled to a side wall of said upper clamping member and extending beyond the end thereof, and wherein said bell crank pivots about a bolt extending through said bracket.

9. The improvement of claim 8 wherein said abutment means is a portion of said bracket.

10. The improvement of claim 9 wherein said link means includes a plurality of members extending on either side of said bell crank second arm portion to said indentations on said wedge.

11. The improvement of claim 1 which further includes a tubular member removably coupled to said first bell crank arm which provides an elongated handle for the brake.

12. The improvement of claim 1 which further comprises means for adjusting the length of said link means thereby regulating the amount of clamping force.

13. The improvement of claim 12 wherein said link means comprises a threaded stud and connector means coupled to said pressure member and said bell crank second arm portion for receiving opposite ends of said threaded stud.

14. The improvement of claim 13 wherein said connector means includes a U-shaped bracket having a threaded opening in the crosspiece portion for receipt of one end of the stud, and including a removable coupling pin passing through holes in end portions of the bracket wherein relative rotational movement between said stud and bracket will result in altering the length of said link means.

15. The improvement of claim 13 which further comprises means for preventing further rotational movement of said threaded stud after the selected length of the link means has been obtained.

16. The improvement of claim 14 wherein said prevention means comprises at least one jamb nut on said threaded stud for engaging said connector means.

* * * * *